US008225952B2

(12) United States Patent
Chen

(10) Patent No.: US 8,225,952 B2
(45) Date of Patent: Jul. 24, 2012

(54) 3D TUMBLER STRUCTURE

(76) Inventor: Ching-Tien Chen, Tainan County (TW)

( * ) Notice: Subject to any disclaimer, the term of this patent is extended or adjusted under 35 U.S.C. 154(b) by 119 days.

(21) Appl. No.: 12/827,622

(22) Filed: Jun. 30, 2010

(65) Prior Publication Data

US 2012/0000922 A1 Jan. 5, 2012

(51) Int. Cl.
*B65D 3/22* (2006.01)
*B65D 8/04* (2006.01)
*B65D 90/02* (2006.01)

(52) U.S. Cl. ..... 220/62.12; 220/592.17; 220/62.14

(58) Field of Classification Search ..... 220/62.12, 220/62.14, 62.18, 592.16, 592.17; 206/457
See application file for complete search history.

(56) References Cited

U.S. PATENT DOCUMENTS 6,525,111 B1 * 2/2003 Spencer et al. ..... 523/218
6,921,179 B2 * 7/2005 Diak Ghanem ..... 362/84
2005/0045643 A1 * 3/2005 Ghanem ..... 220/592.17

* cited by examiner

*Primary Examiner* — Harry Grosso
(74) *Attorney, Agent, or Firm* — Muncy, Geissler, Olds & Lowe, PLLC

(57) ABSTRACT

The present invention provides a 3D tumbler structure including an inner tumbler body, made of a transparent material, having an accommodating space therein; a metallic painting layer, coated on the outer surface of the inner tumbler body, wherein when at least one soft magnet is provided in the accommodating space, the metallic powders contained in the metallic painting layer will be attracted and gathered by the soft magnet to form patterns with 3D halo effect according to the shape of the soft magnet; and an outer tumbler body, made of a transparent material, covering on the inner tumbler body and the metallic painting layer to form a integral tumbler structure by an injection molding process for providing a 3D visual effect. Therefore, the present invention can provide enhanced texture and distinguishability for the tumbler.

3 Claims, 5 Drawing Sheets

3D TUMBLER STRUCTURE

FIELD OF THE INVENTION

The present invention is related to a tumbler structure, and more particularly to a 3D tumbler structure improvement which is formed by an inner tumbler body having an outer surface coated with a metallic painting layer and covered by a transparent outer tumbler body.

BACKGROUND OF THE INVENTION

In our daily life, tumblers have become indispensable necessities, such as for drinking in various occasions. Therefore, there have developed many styles and functions for the tumblers. For example, patterns are mounted or printed on the outer surface of the tumbler, or structure, material or shape of the tumbler is changed for increasing advertising effect or selling.

Owing to the mature of mass production technology, the design of the tumbler has developed to provide differentiability and distinguishability. However, for the thermal printing, although the patterns printed on the surface of the tumbler can provide the user with different choices, after a long period of usage, the printed patterns might be peeled off to cause a spoiled appearance. Moreover, the printing only can provide 2D patterns, which obviously is hard to show texture and provide distinguishability.

Consequently, the applicant keeps on carving unflaggingly through wholehearted experience and research to develop a 3D tumbler structure.

SUMMARY OF THE INVENTION

The object of the present invention is to provide a 3D tumbler structure which can enhance texture and distinguishability. The 3D tumbler structure is formed by coating a metallic painting layer on an outer surface of an inner tumbler body with a soft magnet placed inside the inner tumbler body, so that the soft magnet can affect the attraction of the metallic painting layer, and then covering an outer tumbler body on the inner tumbler body and the metallic painting layer to form an improved tumbler structure with 3D visual effect, which provides not only distinguishability but also industrial value.

For achieving the object described above, the present invention provides a 3D tumbler structure including an inner tumbler body made of a transparent material and having an accommodating space therein; a metallic painting layer coated on the outer surface of the inner tumbler body, wherein when coating the metallic painting layer, soft magnets are placed in the accommodating space and annularly attached to the inner surface of the inner tumbler body or the soft magnets are placed in a mold first and then the mold is coupled by the inner tumbler body to achieve the same effect of placing the soft magnets in the accommodating space, so that the metallic powders contained in the metallic painting layer will be attracted and gathered at a magnetic pole by the magnetic line of force to form patterns with 3D halos; and an outer tumbler body made of a transparent material covering on the inner tumbler body and the metallic painting layer for providing a 3D visual effect.

Therefore, the present invention is advantageous of:

1. Visual distinguishability: After the metallic painting layer is painted, the metallic powders contained in the metallic painting layer are attracted and gathered to form a visual effect of 3D halos which is not only unique but also distinguishable according to the shape formed by the soft magnets placed in the accommodating space.

2. Low cost: By employing a newly developed manufacturing procedure, the tumbler structure can keep simple without increasing the cost.

3. Industrial practicability: In addition to the transparent tumbler body, the present invention also can be applied to different containers, such as pots, bowls and basins.

4. Great advertising effect: The soft magnet can be easily cut or hollowed out to form different kinds of patterns, e.g., logos or labels, for satisfying various customized demands and also providing great advertising effect.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
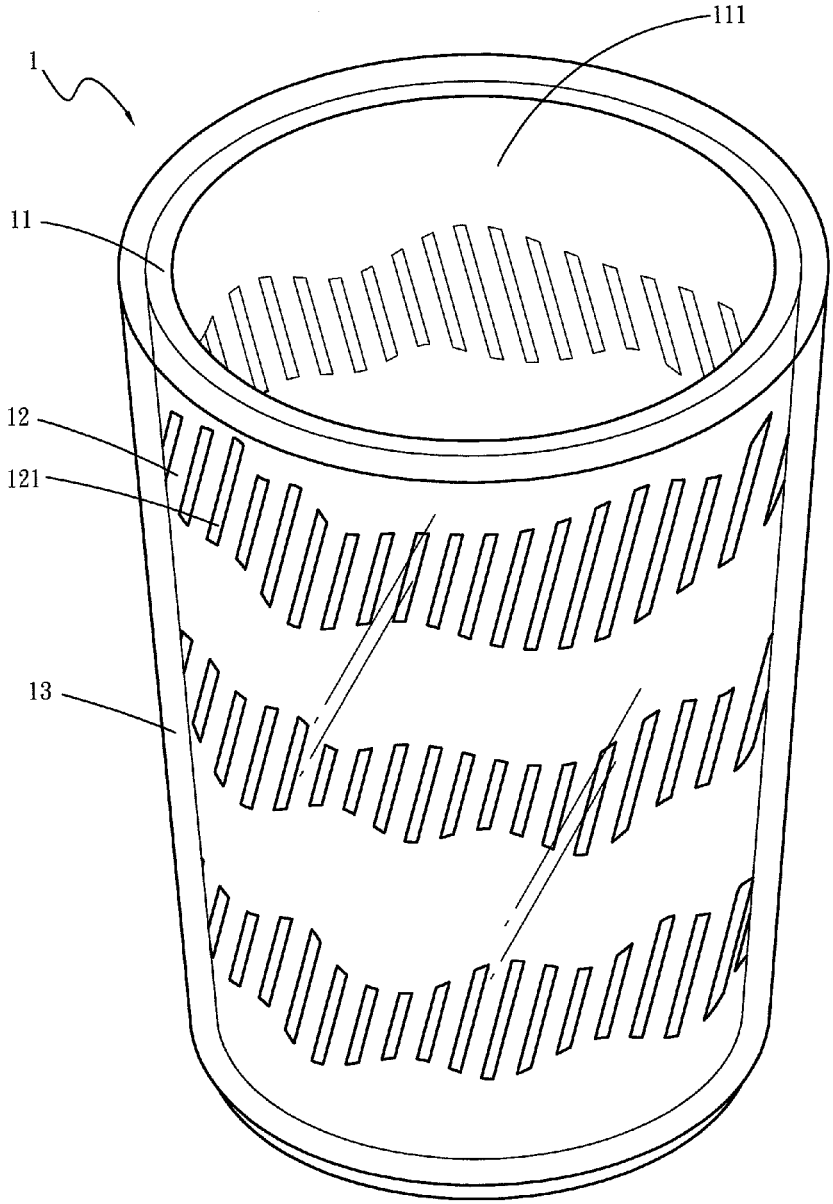
FIG. 1 is a perspective view showing the present invention.
Figure 2:
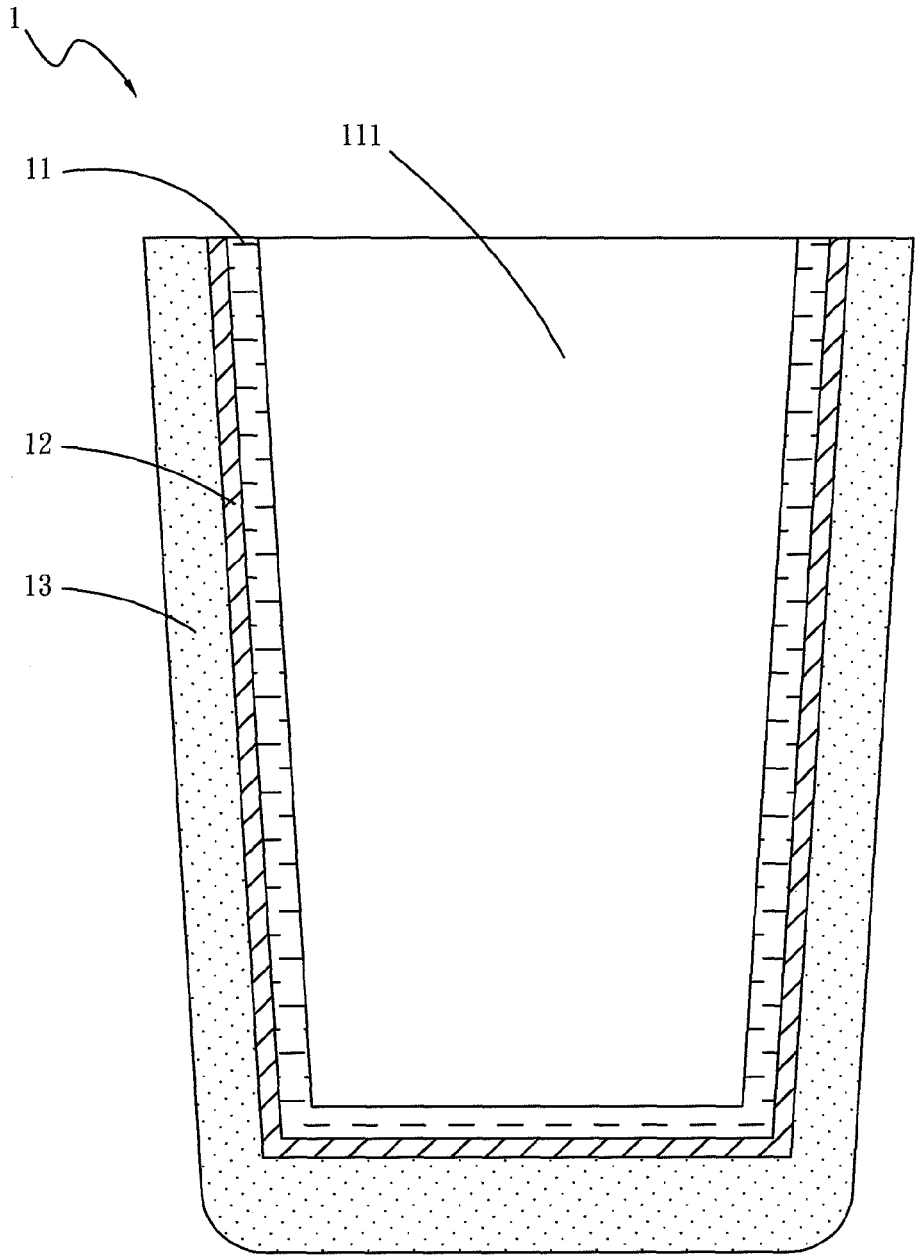
FIG. 2 is a sectional view of FIG. 1.
Figure 3:
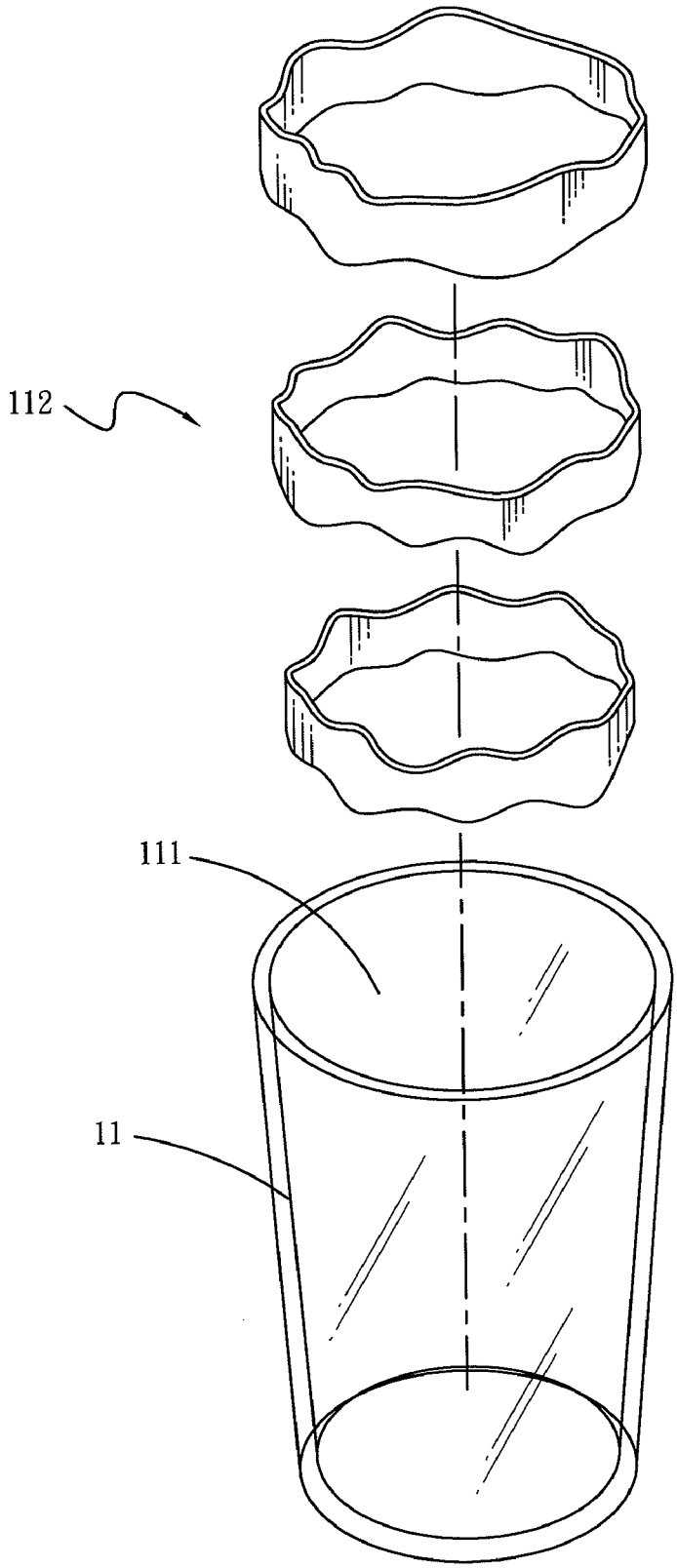
FIG. 3 is an exploded view showing the arrangement of soft magnets placed inside the inner tumbler body.
Figure 4:
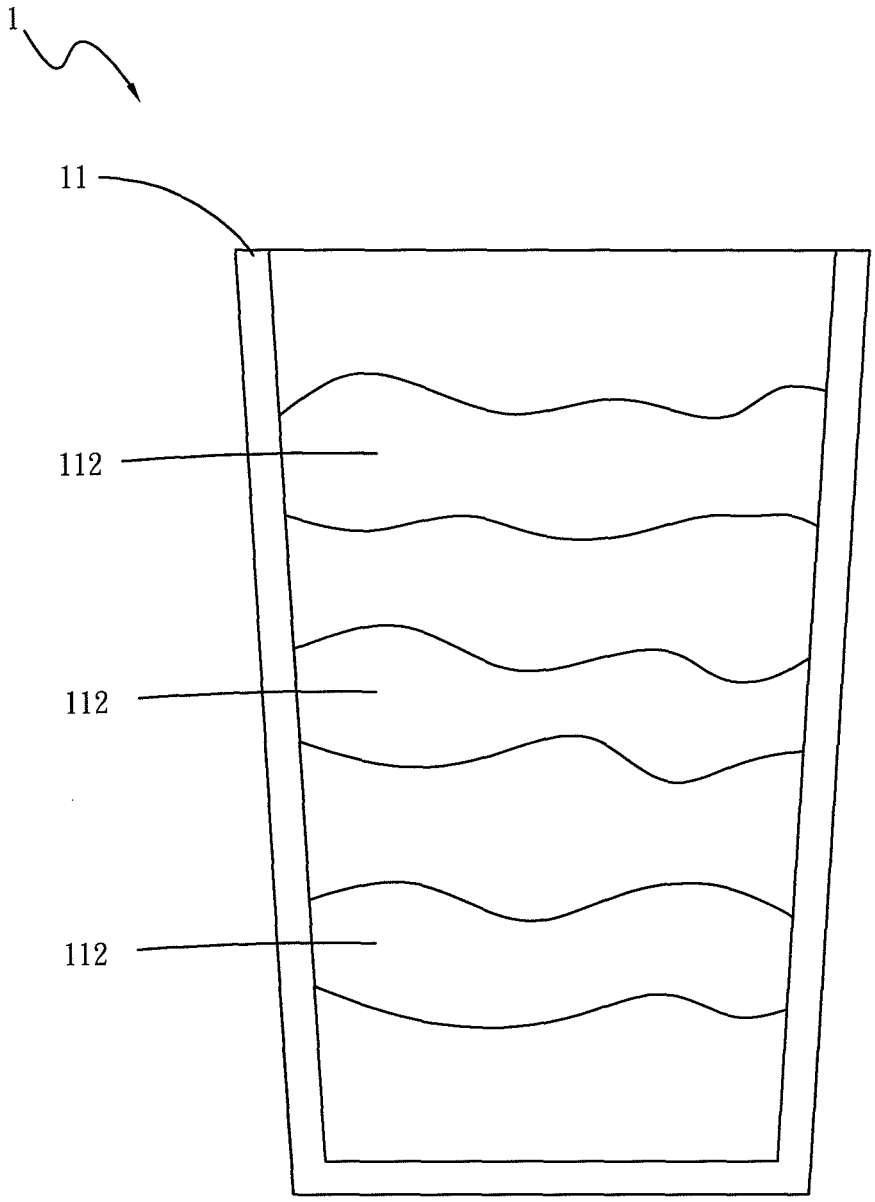
FIG. 4 is a front view showing the assembled tumbler structure of FIG. 3.
Figure 5:
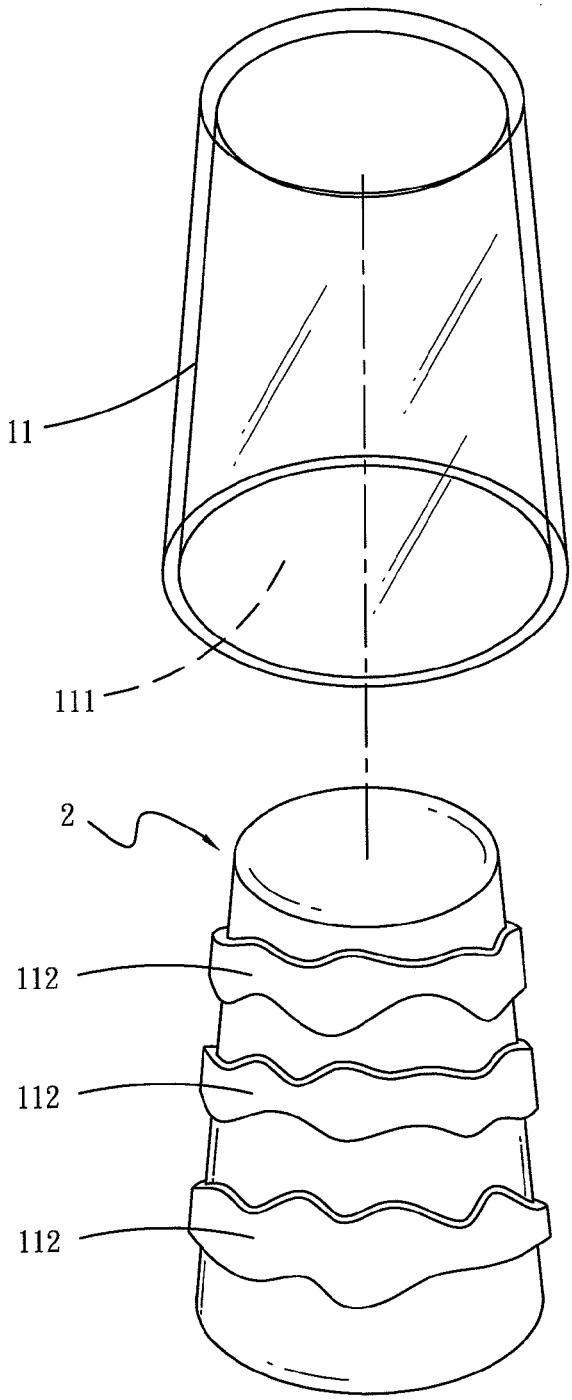
FIG. 5 is an exploded view showing the arrangement of the inner tumbler body and a mold in another embodiment of the present invention.

Please refer to FIG. 1 to FIG. 5. The 3D tumbler structure of the present invention is a tumbler 1 including an inner tumbler body 11, a metallic painting layer 12 and an outer tumbler body 13, wherein:

the inner tumbler body 11 is made of a transparent material, such as plastic or glass, and has an accommodating space 111 therein;

the metallic painting layer 12 is coated on the outer surface of the inner tumbler body 11;

the outer tumbler body 13 is made of a transparent material, such as plastic or glass, and covers the inner tumbler body 11 and the metallic painting layer 12 to form a tumbler structure.

The method for manufacturing the 3D tumbler structure of the present invention includes steps of: providing a inner tumbler body 11 which is made of a transparent material and has an accommodating space 111 therein; placing at least a soft magnet 112 in the accommodating space 111 of the inner tumbler body 11, wherein the soft magnet 112 is compounded of magnetic powders and rubber and can be easily cut or hollowed out to form patterns or characters, and the soft magnet 112 can be annularly attached to the inner surface of the inner tumbler body 11 or to couple on an outer edge of a mold 2, which is then coupled by the inner tumbler body 11 to achieve the same effect; forming a metallic painting layer 12 on the outer surface of the inner tumbler body 11 by spraying, spreading or immersing, wherein the metallic powders contained in the metallic painting layer 12 will be attracted and gathered up by magnetic pole and magnetic line of force of the soft magnets 112 to form plural strip-shape patterns 121, so as to show the effect of 3D halos; and covering an outer tumbler body 13 on the inner tumbler body 11 and the metallic painting layer 12 to form a tumbler structure by an injection molding process, wherein the outer tumbler body 13 is made of a transparent material.

In the aforesaid, the present invention not only overcomes the drawbacks in the prior art to provide practicability and industrial value, but also can be applied to other kinds of containers, such as, pots, bowls, or basins.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A 3D tumbler structure, comprising:

an inner tumbler body, made of a transparent material, including an accommodating space therein;

a metallic painting layer, coated on an outer surface of the inner tumbler body and including metallic powders attracted and gathered by a soft magnet placed in the accommodating space of the inner tumbler body to form 3D halos; and an outer tumbler body, made of a transparent material, covering on the inner tumbler body and the metallic painting layer to form an integral tumbler structure.

2. The 3D tumbler structure as claimed in claim 1, wherein the outer tumbler body covers the inner tumbler body and the metallic painting layer by an injection molding process.

3. The 3D tumbler structure as claimed in claim 1, wherein the transparent material is plastic or glass.

* * * * *